United States Patent [19]

Turner

[11] Patent Number: 4,630,624

[45] Date of Patent: Dec. 23, 1986

[54] COIN ESCROW APPARATUS FOR COIN OPERATED EQUIPMENT

[76] Inventor: James R. Turner, 4602 E. Pueblo, Phoenix, Ariz. 85040

[21] Appl. No.: 820,977

[22] Filed: Jan. 22, 1986

[51] Int. Cl.[4] ..... G07D 1/00

[52] U.S. Cl. ..... 133/4 A; 194/346; 74/104; 74/107

[58] Field of Search ..... 133/1 R, 4 A, 4 R; 194/346, 216, 226, 215; 251/212; 74/104, 107; 222/485, 486, 487, 556

[56] References Cited

U.S. PATENT DOCUMENTS

| | | | |
|---|---|---|---|
| 809,693 | 1/1906 | Johnston | 74/107 |
| 2,283,396 | 5/1942 | Towne | 194/346 |
| 2,642,496 | 6/1953 | Dewar | 194/346 X |
| 2,823,710 | 2/1958 | Angel | 74/104 X |
| 3,260,338 | 7/1966 | La Barge | 194/246 |
| 3,916,922 | 11/1975 | Prümm | 194/346 X |
| 3,998,426 | 12/1976 | Isbester | 251/212 X |
| 4,337,675 | 7/1982 | Holdeman | 74/104 X |
| 4,378,706 | 4/1983 | Miyamoto | 74/104 X |
| 4,393,972 | 7/1983 | Maloy | 194/346 |
| 4,437,557 | 3/1984 | Kölbl et al. | 194/346 |

FOREIGN PATENT DOCUMENTS

| | | | |
|---|---|---|---|
| 1774010 | 8/1971 | Fed. Rep. of Germany | 194/346 |
| 1311230 | 10/1962 | France | 194/346 |

*Primary Examiner*—Joseph J. Rolla
*Assistant Examiner*—P. McCoy Smith
*Attorney, Agent, or Firm*—H. Gordon Shields

[57] ABSTRACT

Escrow apparatus for coin operated equipment includes a pair of interleaved door panels disposed at an angular orientation with respect to each other and pivotally movable between a pair of fixed walls. The panels with the walls define a coin receiving escrow chamber or bucket. The door panels are selectively pivotable to allow coins disposed in the bucket to move either to a return path for returning the coins to a user of the apparatus, or to a coin box.

21 Claims, 6 Drawing Figures

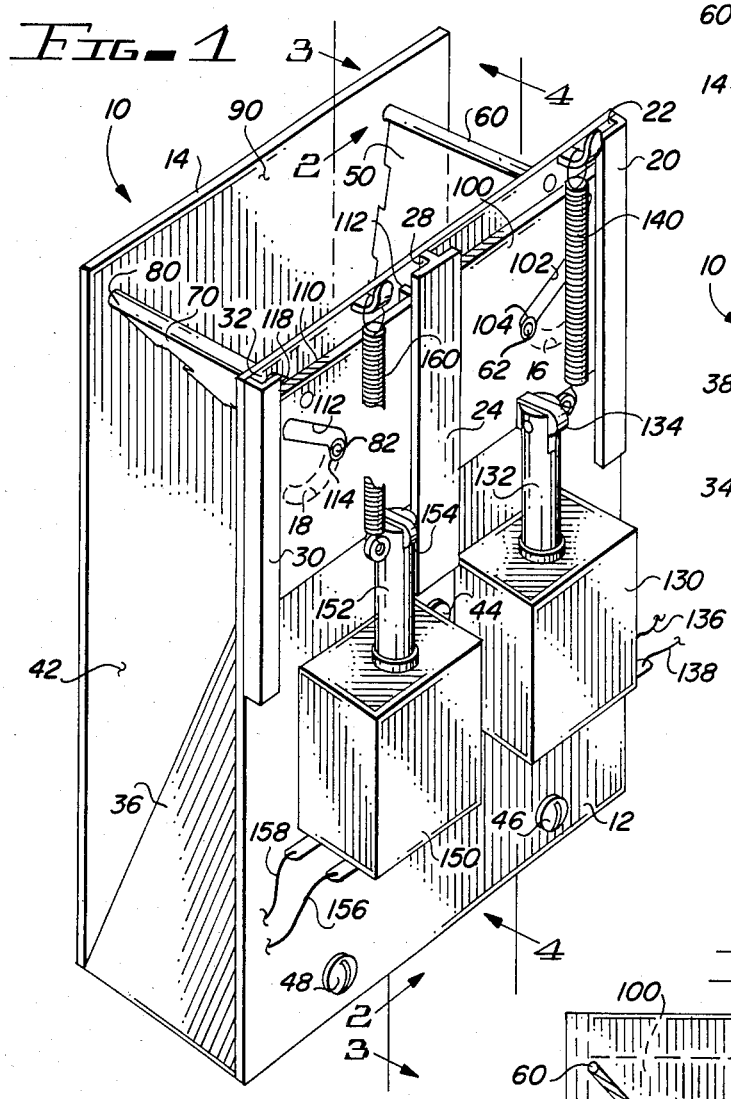
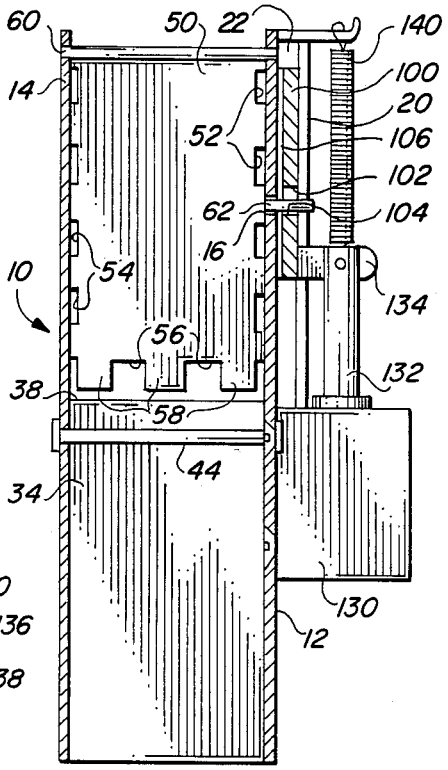
FIG. 2
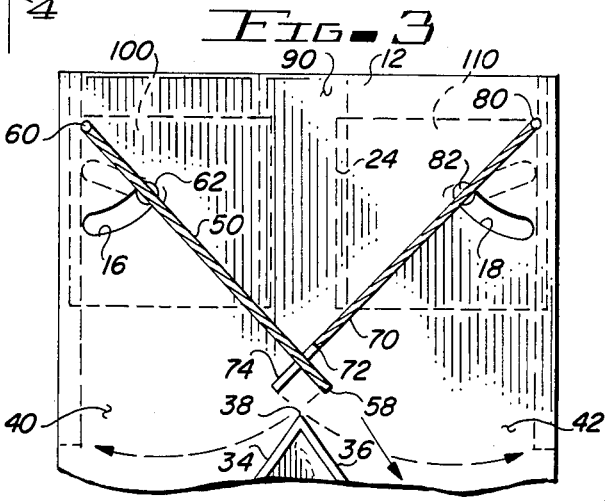
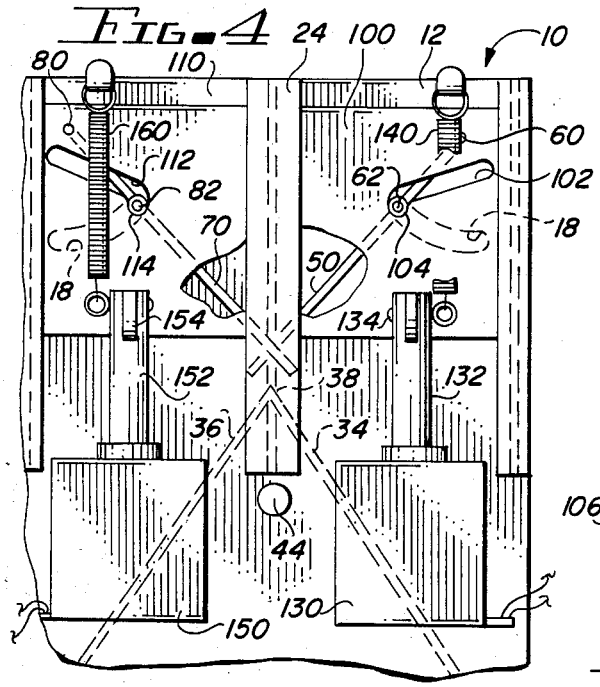
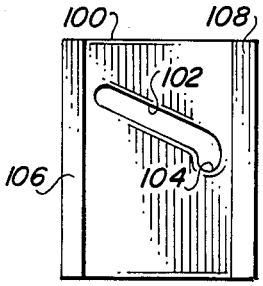
FIG. 5
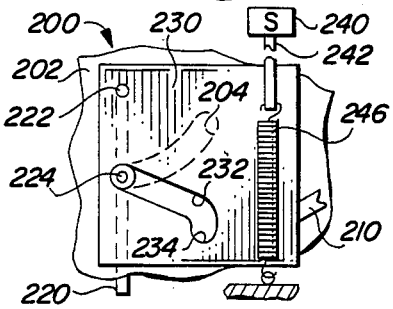
FIG. 6

COIN ESCROW APPARATUS FOR COIN OPERATED EQUIPMENT

BACKGROUND OF THE INVENTION

1. Field of the Invention

This invention relates to coin operated equipment, and, more particularly, to escrow apparatus for holding coins until a determination is made whether the coins should be returned to the user of the apparatus or to a coin box upon actuation of the coin operated equipment.

2. Description of the Prior Art

Coin escrow apparatus is typically used in equipment operated by coins when the coins will either be returned to the user or will be sent to a coin box upon actuation of the equipment. A well known and typical example is the use of an escrow assembly for pay telephones. In a pay telephone, after coins are put into the equipment, the coins go to an escrow assembly. If the telephone call goes through, then the coins move to a coin box. If the telephone call does not go through, the coins are then returned to the user of the equipment.

Coin escrow apparatus generally includes two separate paths for the coins to follow from the escrow box. The escrow box includes two movable panels or doors, with one door controlling one path, and the other door or panel controlling the other path. Accordingly, if the coin is to be returned to the user, the return door or panel opens and directs the coin along a return path. If the coin is to go to the coin box, then the coin box door or panel opens, and the coin is directed to a coin box path.

The prior art escrow assemblies are generally characterized by relatively complicated mechanical leverage systems for operating or actuating the door panels. The apparatus of the present invention is characterized by relatively simple mechanical leverage operated through straight line solenoid operation for simplicity of manufacturing, ease of maintenance, and convenience of manufacturing.

U.S. Pat. No. 2,283,396 discloses a coin trap which holds a single coin. Subsequent coins are held in abeyance until the coin trap dispenses its coin. The coin trap pivots on a single axis in opposite directions to dispense a coin either to a coin box, in one direction, or to a coin return slot, in the other direction.

U.S. Pat. No. 2,642,496 discloses a coin box only very generally. It appears that the coin box in this patent also pivots in two directions from a "hold" position so that coins are either returned or sent to a coin collection box, depending on which way the coin box pivots. The patent disclosed details of coin guides which guide the coins to the coin box or escrow holder, and to remote actuation apparatus.

U.S. Pat. No. 3,260,338 discloses a coin escrow system in which a pair of vanes pivot under solenoid actuation. The vanes intermesh at their lower, outer ends so that a coin or a plurality of coins remain between the vanes until a particular solenoid is actuated. Actuation of one of two solenoids causes the pivoting movement of one of the vanes to direct the coins held between the two vanes either to a coin return slot or to a coin box, depending on which solenoid is actuated.

U.S. Pat. No. 3,916,922 discloses a coin testing apparatus in which a plurality of pivoting vanes are used to guide or to route coins in proper, predetermined paths, depending on the coin element deposited in the apparatus. There are several stages of pivoting flaps or valves, and the pivoting of the flaps directs a coin to a particular stage and on to a next lower stage, where, ultimately, the coins or slugs are stored. Different denomination coins are routed appropriately. Also, slugs, or the like, are rejected.

U.S. Pat. No. 4,437,557 discloses a swivel plate which pivots on a center axis to route coins to an appropriate path. One path is a return path, and the other path is a coin box path. The pivoting of a single swivel plate is accomplished by mechanical linkage.

German patent DE No. 17 7 4 010 B 2 discloses another type of coin escrow system in which doors are held closed by spring action. The doors are opened, against the bias of tension springs, by solenoids. The solenoids are disclosed at the ends of the doors, and remote from the pivot points of the doors. Actuation of the solenoid raises the outer ends of the doors, causing the lower portion of the doors to move in a direction to allow coins disposed between the doors to be routed either to a coin box or to a return slot. Details of the electrical circuitry are also discussed.

SUMMARY OF THE INVENTION

The invention described and claimed herein comprises a coin escrow assembly for coin operated equipment which utilizes a pair of movable flapper valves pivotally secured to a pair of fixed wall panels. The flapper valves pivot to provide and control paths for coins held in a bucket defined between the fixed wall panel and the movable flapper valves. The paths include a return coin path and a coin box path. Pivoting of the flapper valves is accomplished through the operation of solenoids. A solenoid is secured to a movable actuating panel. The movable actuating panel includes a cam slot in which is disposed a rod or pin secured to the door or valve panel, and movement of the solenoid and the movable actuating panel causes a pivoting movement of the door panel. The pivoting action of both of the flapper valves is substantially the same, and accordingly each includes its own solenoid, movable actuating panel, cam slot, and pin.

Among the objects of the present invention are the following:

to provide new and useful coin escrow apparatus;

to provide new and useful coin escrow apparatus having a pair of pivotable door panels defining a coin escrow bucket between them, and movable in response to solenoid action;

to provide new and useful coin escrow apparatus including a panel pivotable between a closed position and an open position; and to provide new and useful coin escrow apparatus having a panel pivotable in response to the movement of a movable panel having a cam slot therein which cooperates with a pin on the pivotable door panel.

BRIEF DESCRIPTION OF THE DRAWING

FIG. 1 is a perspective view of the apparatus of the present invention.

FIG. 2 is a view in partial section taken generally along line 2—2 of FIG. 1.

FIG. 3 is a view in partial section of a portion of the apparatus of FIG. 1, taken generally along line 3—3 of FIG. 1.

FIG. 4 is a side view of a portion of the apparatus of FIG. 1, taken generally along line 4—4 of FIG. 1.

FIG. 5 is a plan view of a portion of the apparatus of the present invention.

FIG. 6 is a schematic representation of an alternate embodiment of a portion of the apparatus of the present invention.

DESCRIPTION OF THE PREFERRED EMBODIMENT

FIG. 1 is a perspective view of coin escrow apparatus 10 of the present invention. The coin escrow apparatus 10 includes a pair of fixed side panels 12 and 14 spaced apart from each other. The side panels 12 and 14 define the sides of the apparatus and also comprise the fixed sides of a coin escrow box 90 defined within the sides 12 and 14 and a pair of movable panels or flapper valves 50 and 70. The side panels 12 and 14 also define or comprise sides for a coin box path 40 and for a coin return path 42.

The coin box path 40 is defined between the sides 12 and 14 and above a lower fixed path 34 (see FIGS. 2, 3, and 4), which is disposed beneath the flapper valve 50. The coin return path 42 is defined between the side panels 12 and 14 and above a lower fixed plate 36 and the flapper valve 70.

FIG. 2 is a view in partial section of a coin escrow apparatus 10 taken generally along line 2—2 of FIG. 3, with the wall panels 12 and 14 shown in partial section. FIG. 3 is a view in partial section of a portion of the coin escrow apparatus 10, taken generally along line 3—3 of FIG. 1, and looking from within the coin escrow apparatus 10 at the inside of the coin escrow box 90 towards the panel 12, the coin box path 40, the coin return path 42, and some of the elements associated therewith.

FIG. 4 is a side elevation view of a portion of the coin escrow apparatus 10, taken generally along line 4—4 of FIG. 1, and looking at the side panel 12 and at some of the elements on the outside of the apparatus 10. FIG. 5 is a plan view of an element of the apparatus of the present invention. For the following discussion, reference will primarily be made to FIGS. 1, 2, 3, 4, and 5.

The fixed plates 34 and 36 are appropriately secured between the fixed side panels 12 and 14, and are at an angular orientation with respect to the vertical. That is, the fixed panels 34 and 36 extend downwardly and outwardly from an apex 38 which is defined at the upper juncture of the two panels.

The panel 34 is disposed beneath the flapper valve 50, and when the flapper valve 50 moves from its closed position to its open position, coins fall from the coin escrow box 90 onto the fixed panel 34 and downwardly to a coin box (not shown) via the coin box path 40.

The panel 36 is disposed beneath the flapper valve 70. When the valve 70 pivots from its closed position to its open position, coins fall from the escrow box 90 downwardly onto the fixed panel 36 and to a return slot (not shown) via the coin return path 42. The flapper valves 50 and 70 thus respectively control the coin box path 40 and the coin return path 42.

The apex 38 of the fixed plates 34 and 36 is preferably centered with respect to the movable panels or flapper valves 50 and 70.

The side panels 12 and 14 are appropriately secured together, with the lower, fixed panels 34 and 36 disposed therebetween by a plurality of appropriate fasteners, such as screws 44, 46, and 48, as best shown in FIG. 1.

Secured to the outside surface of the side panel 12 is a plurality of guide elements or guide flanges, including a guide flange 20, a double guide flange 24, and a guide flange 30. The guide flanges, with the side panel 12, comprises a plurality of tracks or grooves in which actuator panels, including an actuator panel 100 and an actuator panel 110, are movably disposed.

The side 12 and the guide flange 20 define a track or groove 22. The double guide flange 24, together with the side 12, defines a pair of back-to-back tracks or grooves 26 and 28. The track or groove 22 and the track or groove 26 face each other, and comprise a pair of tracks or grooves in which the actuator panel 100 is disposed. The side 12 and the guide flange 30 define a track or groove 32. The tracks or grooves 28 and 32 comprise a pair of grooves in which is disposed the actuator panel 110.

A pair of arcuately extending cam slots 16 and 18 extend through the side 12. The cam slot 16 is disposed between the tracks or grooves 22 and 26, and the cam slot 18 is disposed between the tracks or grooves 28 and 32. The actuator panels 100 and 110 cover the cam slots 16 and 18, respectively, on the outside or outer surface of the side panel 12.

The flapper valve or panel 50 is appropriately suspended between, and pivotally secured to, the side panels 12 and 14 by a pivot rod 60. The flapper valve 50 is best shown in FIG. 2. From the view of the flapper valve 50 as shown in FIG. 2, it will be noted that the flapper valve or panel 50 includes a plurality of slots 52 on one side of the valve, and a plurality of slots 54 on the opposite side of the valve 50 from the slots 52. The slots 52 and 54 define relieved portions which extend inwardly from the outer edges of the flapper valve 50. The purpose of the slots is to reduce the surface area of the flapper valve 50 which contacts the side panels 12 and 14 as the valve 50 moves. The dimensions of the slots on the sides of the flapper valve 50 are sufficient to reduce frictional engagement between the valve and the side panels, but are yet sufficiently small so that a coin is not able to slip therethrough. Thus, a coin, once deposited into the coin escrow box 90, remains there until either the flapper valve 50 or the flapper valve 70 is actuated.

At the distal end of the flapper valve 50, remote from the upper end at which the pivot rod 60 is disposed, are a plurality of slots 56. Adjacent to the slots 56 are a plurality of extended fingers 58.

Between the distal end of the flapper valve 50 and the pivot rod 60 is a cam rod or pin 62. The cam rod or pin 62 extends through the cam slot 16 in the side 12. Movement of the rod or pin 62 in the slot 16 results in a pivoting movement of the flapper valve 50 on the pivot rod 60. This will be discussed in detail below.

The flapper valve is substantially identical to the flapper valve 50. It includes a pivot rod 80 at its upper end, a plurality of slots or relieved portions at its side edges, (not shown) and a plurality of alternating slots 72 and fingers 74 on its distal end, remote from its pivot pin 80.

As best shown in FIG. 3, when the flapper valves 50 and 70 are in their closed position, to define, with the sides 12 and 14, a coin escrow box 90, the slots and fingers at the distal ends of the flapper valves are intertwined or interleaved. In FIG. 3, a finger 58 of the flapper valve 50 is shown disposed within a slot 72, and adjacent to a finger 74 of the flapper valve 70.

Also shown best in FIG. 3 in addition to a showing in FIG. 4 in phantom, is the relationship between the lower fixed plates 34 and 36 and the flapper valves 50 and 70. It will be noted that the bottom of the coin box 90, or the intersection of the flapper valves 50 and 70, is disposed above the apex 38 of the juncture of the lower fixed plates 34 and 36. It will also be noticed that the interleaving of the fingers and slots at the distal ends of the flapper valves 50 and 70, remote from their respective pivot rods 60 and 80, provides a slight overhang into the coin box path 40 and the coin return path 42 as the flapper valves 70 and 50 are respectively pivoted. That is, when the flapper valve 50 is pivoted to allow coins disposed within the coin escrow box 90 to fall or float to the coin box path 40, the fingers 74 of the flapper valve 70 overhang slightly beyond the apex 38. Thus, coins in the escrow box 90 fall directly onto the lower fixed plate 34, and thus it is highly unlikely that the coins could fall onto the lower fixed plate 36, and thus into the coin return path 42 by accidental means. Similarly, when flapper valve 70 pivots to allow coins from the coin escrow box 90 to fall into the coin return path 42, the distal fingers 58 of the flapper valve 50 overly the lower, fixed panel 36 so that coins from the coin escrow box 90 fall directly into the path 42, and onto the fixed path 36. There is thus virtually no chance that any coin will accidentally fall into the coin box path 40 and onto the lower plate 34 instead of falling onto the panel 36 and into the coin return path 42.

The heavy curved arrows in FIG. 3 show generally the arcuate pivoting paths of the respective flapper valves 50 and 70. In addition, FIG. 3 shows the arcuate slots 16 and 18 in which the cam rods 62 and 82, respectively, are disposed and in which they move for pivoting the flapper valves 50 and 70, respectively. It will be noted that the cam rods 62 and 82 are shown in phantom in FIG. 3.

It will also be noted, as best illustrated in FIG. 3, that the side panel 12 actually comprises two portions which are virtual mirror images of each other. Thus, the panel 12 may be divided into two portions, vertically, or halved by a vertical line extending through the center of the double guide flange 24, (see also FIG. 1), and through the apex 38 of the lower fixed panels 34 and 36. This vertical division puts the lower fixed panels 34 and 36 on different halves of the panel 12. The two halves or portions of the side panel 12 accordingly comprise virtual identical halves which are mirror images of each other.

For controlling the pivoting of the flapper valves 50 and 70, a pair of actuator panels is used. As has been discussed above, the actuator panels include the panel 100 and the panel 110. As has also been discussed, the actuator panels 100 and 110 are disposed on the outside of the panel 12, and thus remote from the flapper valves 50 and 70 and the lower fixed panels 34 and 36. The panels 100 and 110 are also disposed in the guide slots 22, 26 and 28, 32, respectively.

The actuator panel 100, best shown by itself in FIG. 5, includes an actuator slot 102, which extends at a diagonal angle across the center of the panel. The panel 100 is, of course, generally of a rectangular configuration.

Extending downwardly from the lower portion of the actuator slot 102 is a lock notch 104. The lock notch 104 cooperates with the cam pin or cam rod 62 to lock the flapper valve 50 in its closed position, and thus prevents the inadvertent movement of the flapper valve 50 until the actuator panel 100 moves downwardly, away from the position shown in FIGS. 1, 2, 3, and 4, to cause the flapper valve 50 to pivot.

The actuator panel 110 is substantially identical to the actuator panel 100, except that it is a mirror image thereof. The act ator panel 110 includes an angularly or diagonally extending actuator slot 112, and a lock notch 114 extending downwardly from the lower portion of the slot 112.

As best shown in FIG. 4, but also indicated in FIGS. 1, 2, and 3, the actuator slots 102 and 112 of the actuator panels 100 and 110, respectively, overly a portion of the cam slots 16 and 18, respectively, of the side panel 12. It will be noted, as best shown in FIG. 3, that the cam slots 16 and 18 are arcuately extending, while the actuator slots 102 and 112 are relatively straight, though diagonally extending. The reason for this is, of course, that the flapper valves 50 and 70 pivot on their pivot rods 60 and 80, respectively, and thus the path traced by their cam rods or cam pins 62 and 82, respectively, describe an arcuate path. However, the actuator panels 100 and 110 move vertically upwardly and downwardly in a straight line. The cam pins or cam rods 62 and 82, which extend through the cam slots 16 and 18, respectively, and into the actuator slots 102 and 112, respectively, describe curved or arcuate lines as the actuator panels move upwardly and downwardly and as the flapper panels 50 and 70 pivot upwardly and downwardly.

As indicated, the cam pin 62 extends through the cam slot 167 in the side 12, and into the actuator slot 102. When the actuator panel 100 is in its uppermost position, as shown in FIGS. 1, 2, 3, and 4, the flapper valve 50 is in its closed position, as also shown in FIGS. 1, 2, 3, and 4. The cam rod or pin 62 is disposed in the lock notch 104, when the panel 100 is in its up position and when the flapper panel 50 is in its up or closed position.

The cam pin or cam rod 82 extends through the cam slot 18 in the side panel 12 and into an actuator slot 112 of the actuator panel 110. At the lower portion of the actuator slot 112 is a lock notch 114. The cam rod or pin 82 is disposed within the lock notch portion 114 of the actuator slot 112 when the actuator panel 110 is in its upper position, and thus when the flapper 70 is in its closed, or inner or upper positions, as shown in FIGS. 1, 3, and 4. Coins in the coin escrow box 90 also bias the flapper valve 70 downwardly to insure that the pin 82 remains in the notch 114.

As can best be understood from FIG. 3, but as may also be understood from FIGS. 1, 2, and 4, when the flapper valve 50 is in its closed, or upper or inner position, and the flapper valve 70 is also in its closed or upper, inner position, coins falling into the coin escrow box 90, and thus onto the flapper valves 50 and 70, place a downward bias on the flapper valves 50 and 70 by the weight of the coins. Rather than causing the flapper valves to pivot, the weight causes the cam rods or pins of the flapper valves to be biased downwardly into their respective lock notches in the actuator panels. This helps to lock or to hold the flapper valves in their closed positions until or unless the actuator panels move downwardly, or until one of them moves downwardly to allow the coins to fall into either of the coin paths.

Downward movement of the actuator panels 100 and 110 is accomplished by means of solenoid actuators 130 and 150, respectively. The solenoid 130 and the solenoid 150 are both appropriately firmly or fixedly secured to the side panel 12.

The solenoid 130 includes a moving armature 132 which is secured through a link 134 to the actuator panel 100. A pair of conductors 136 and 138 provide electrical current for actuating the solenoid 130 and causing the armature 130 to move downwardly. When the armature 132 moves downwardly, the actuator panel 100 moves downwardly therewith.

A tension spring 140 is secured between the armature 132 and the upper portion of the side panel 12 to cause the armature 132 to move upwardly when current is removed from the conductors 136 and 138. When the armature 132 moves upwardly, the actuator panel 100 also moves upwardly through the connection with the link 134. It will be noted that the length of travel of the armature 132 is preferably relatively short, and, as a practical matter, is a distance of about one-half of an inch. This relatively short distance of travel provides relatively speedy movement of the panel 70 and helps to eliminate complicated or lengthy mechanical movements, mechanical linkages, etc. Also the relatively short distance requires less power consumption than is required by a solenoid having a longer length of movement.

There is a straight line movement of the armature 132 in both the upward and downward direction, followed by, or accompanied by, a correspondingly straight line and relatively short vertical downwardly and upwardly movement of the actuator panel 100. However, during the relatively short vertical movement of the actuator panel 100, the flapper valve 50 moves through a sufficient arcuate distance to allow coins from the coin escrow box 90 to move downwardly into the coin box path 40 and onto the lower fixed panel or plate 34 which extends to the coin box.

The solenoid 150 is substantially identical to the solenoid 130. It includes a moving armature 152 which is secured through a link 154 to the actuator panel 110. A tension spring 160 extends between the armature 154 and the upper portion of the side panel 12. A pair of conductors 156 and 158 provides electrical current for actuating the solenoid 150. When electrical current is removed from the conductors 156 and 158, the armature 152 moves upwardly under the biasing force of the tension spring 160 to cause the actuator panel 110 to move upwardly. The upward movement of the actuator panel 110 is, of course, accompanied by a pivoting movement, generally upwardly and inwardly, of the flapper valve 70.

The downward movements of the actuator panels 100 and 110 by the actuation of the solenoids 130 and 150 and the downward movements of the armatures 132 and 152, and the panels 100 and 110, respectively, cause a downward and outward pivoting of the flapper valves 50 and 70, respectively, to their open positions. An upward movement of the armatures 132 and 152, and of the actuator panels 100 and 110, respectively, under the urging or biasing force of the tension springs 140 and 160, respectively, causes an inward and upward pivoting movement of the flapper valves 50 and 70 to their closed positions. In their closed positions, of course, they define the bottom portion of the coin escrow box 90. Obviously, both solenoids 130 and 150 will not be actuated at the same time. Rather, they are actuated selectively and separately to allow coins from the escrow box 90 to fall either into the coin box path 40 or into the coin return path 42.

As can best be understood from FIGS. 3 and 4, the movement of the flapper valves 50 and 70, when their respective solenoids 130 or 150 are actuated, results in a pivoting or arcuate movement of about forty-five degrees for the flapper valves 50 and 70. In the full down or open positions of the flapper valves 50 and 70, the flapper valves are substantially vertically oriented, thus opening the respective coin paths 40 and 42 to their maximum extent.

Positive actuation of the solenoids 130 or 150 must occur before the coin escrow box 90 will be opened to allow coins to proceed down either of the coin paths. This is assured by the tension springs 140 and 160 and by the lock notches 104 and 114 in the actuator panels 100 and 110, respectively. However, once the electric current is released from the solenoids, the flapper valves close automatically, or move automatically to the closed positions, under the bias of the tension springs. Thus, while the electrical power is required to open the flapper valves, electrical current is not required to close the flapper valves.

Under some circumstances, it may be advantageous to have the coin return path open at all times so that, in the event of a power failure, a user of the apparatus would automatically be refunded money deposited into the apparatus and into the coin escrow box. With a power failure, the apparatus would generally be inoperative, and a user should not lose money. Such an arrangement is illustrated in FIG. 6, which comprises a semi-schematic representation of an alternate embodiment of a portion of the apparatus illustrated in FIGS. 1–5.

In FIG. 6, an actuator panel 210 is illustrated. The actuator panel 230 is secured on a fixed side panel 202, which is comparable to the panel 12. The panel 230 moves in a similar manner to the vertical movement of the panel 110, on the side panel 202 in guide tracks or grooves (not shown). For convenience of illustration, the guide elements or flanges required for the guide tracks or grooves have been omitted in FIG. 6. In other respects, the actuator panel 210 operates in the reverse manner from the operation of the guide panels 100 and 110 in that a flapper valve is normally open, and movement of the actuator panel by a solenoid closes the flapper valve.

FIG. 6 is a fragmentary semi-schematic representation of an alternate embodiment 200 of the apparatus of the present invention. For convenience of illustration, only a portion of the fixed side panel 202 of a coin escrow apparatus 200 is illustrated. The side panel 202 includes an arcuately extending cam slot 204.

A portion of the flapper valve 210 is shown in its upper or inward, closed position. The flapper valve 210 is appropriately pivoted between a pair of side panels, including the side panel 202. The flapper valve 210 controls access to a coin box path and is in its normally closed position. It operates substantially as described above for the flapper valve or panel 50.

Also secured between the pair of side panels, including the side panel 202, is a flapper valve 220. The flapper valve 220 controls the coin return path, while the flapper valve 210 controls the coin box path. While the flapper valve 210 is in its closed position, the flapper valve 220 is in its open position.

The flapper valve 220 is secured between the two side panels of the apparatus 200 by a pivot pin or pivot rod 222. Extending through the cam slot 204 in the side panel 202 is a cam pin or rod 224.

The actuator panel 230 is, as indicated above, generally of a rectangular configuration and in general appearance. However, the operation of the actuator panel 30 is opposite to the operation of the panels 100 and 110.

The actuator panel 230 includes a diagonally extending actuator slot 222. At the lower end of the actuator slot 232, and extending downwardly therefrom, is a lock notch 234. A portion of the actuator slot 232 and the cam slot 204 overly each other. The cam slot 204 is arcuately extending, while the actuator slot 232 is relatively straight. The slot 232 extends diagonally with respect to the vertical axis of the actuator panel 230 and to the vertical movement of the panel.

Movement of the actuator panel 230 is accomplished by a solenoid 240. The solenoid 240 is appropriately secured to the side panel 202. The solenoid 240 includes a movable armature 242 which extends downwardly from the solenoid 240. The armature 242 is appropriately secured by a link (not shown) to the actuator panel 230. A tension spring 246 is also appropriately secured to the armature 242 and it extends downwardly from the armature 242 to where it is appropriately secured to the fixed side panel 202. The tension spring 246 urges the armature or plunger 242 out of the solenoid 240. The spring 246 thus causes the panel 230 to move downwardly so that the panel 230 moves the flapper valve 220 to its open, or outer or downward position as shown in FIG. 6. The movement of the flapper valve 220 is caused by the movement of the actuator panel 230 through the cam pin or rod 224 which extends through the actuately extending cam slot in the side 202 and into the slot 232 of the panel 230.

As shown in FIG. 6, the normal position of the flapper valve 220 is down, or open, so that a coin placed into the apparatus will automatically fall to a coin return path and thus be returned to the user of the apparatus. The valve 220 is open unless the solenoid 240 is actuated to move the actuator panel 230 upwardly and thus to move the flapper valve 220 to its upper or inner, closed position. Electrical current is required to utilize the apparatus in which the escrow apparatus 200 is employed. In case of electrical power failure, money deposited into the escrow apparatus 200 will automatically be returned to the user.

When electrical power is connected to the apparatus, and a coin is placed into the escrow apparatus 200, the solenoid 240 is actuated to cause the flapper valve 220 to close when the armature 242 moves upwardly and inwardly into the solenoid 240 and against the downward or outward bias of the tension spring 246.

The upward movement of the actuator panel 230 causes the cam pin or rod 224 to move relatively downwardly and inwardly in the slot 232, and arcuately upwardly in the slot 204 to pivot the flapper valve 220 to its closed position. When the flapper valve 220 is in its closed position, and the panel 230 is in its full upward position, the cam pin 224 is disposed in the lock notch 234 of the diagonal actuator slot 232, substantially the same as discussed above in conjunction with the embodiment of FIGS. 1–4. Coins held in the escrow box provide a downward bias on the flapper valves 210 and 220 and tend to more securely lock the flapper valves against inadvertent movement by biasing the flapper valves downwardly into lock notches in their actuator slots, of which the lock notch 234 of the slot 232 for the flapper valve 220 is shown in FIG. 6.

In all other respects, the operation of the escrow apparatus 220 is substantially the same as discussed above, except that electric current remains on the solenoid 240 as long as money is in the coin escrow box or as long as the equipment to which the appartus 200 is secured is in actual use.

When the solenoid which controls the flapper valve 210 is actuated to allow coins from the escrow box of the apparatus 200 to flow to the coin box, power remains on the solenoid 240. Thus, both solenoids in the embodiment of the apparatus 200 may remain actuated at the same time. This is, of course, different from the operation of the solenoids 130 and 150 of the apparatus of FIGS. 1–4.

If coins deposited in the escrow box of the apparatus 200 are to be returned to a user, then electrical power is removed from the solenoid 240, and the flapper valve 220 opens under the bias of the tension spring 246 to allow coins from the escrow box to flow through the coin return path to the user.

Obviously, the design of the flapper valves or panels 210 and 220 is substantially the same as that of the valves or panels 50 and 70.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Coin escrow apparatus comprising, in combination: side panel means, including a first side panel and a second side panel;

slot means in the side panel means including a first slot and a second slot;

first valve means pivotally secured between the first and second side panels and movable between an open and a closed position;

second valve means pivotally secured between the first and second side panels and movable between a closed position adjacent to the first valve means and an open position remote from the first valve means, and defining, with the first and second side panels and the first valve means when both the first and second valve means are in their closed position, a coin escrow box for holding coins;

first actuator panel means disposed adjacent to the first slot;

a first actuator slot in the first actuator panel means overlying a portion of the first slot;

second actuator panel means disposed adjacent to the second slot;

a second actuator slot in the second actuator panel means overlying at least a portion of the second slot;

a first cam rod secured to the first valve means and extending into the first slot and the first actuator slot for pivoting the first valve means in response to movement of the first actuator panel means;

a second cam rod secured to the second valve means and extending into the second slot and the second actuator slot for pivoting the second valve means in response to movement of the second actuator panel means;

first actuator means for moving the first actuator panel means to pivot the first valve means; and second actuator means for moving the second actuator panel means to pivot the second valve means.

2. The apparatus of claim 1 in which the first actuator panel means includes a first actuator panel movable on the side panel means between a first position and a second position, and which first and second positions coincide with the closed and open positions of the first valve means.

3. The apparatus of claim 2 in which the first actuator means includes first actuation means for moving the first actuator panel between the first and the second positions to move the first valve means between its closed and its open positions.

4. The apparatus of claim 3 in which the first actuator means includes a first solenoid actuable to move the first actuator panel to its second position from its first position and to move the first valve means to its open position from its closed position.

5. The apparatus of claim 3 in which the first actuator means further includes a tension spring for moving the first actuator panel to its first position from its second position to move the first valve means to its closed position from its open position.

6. The apparatus of claim 1 in which the second actuator panel means includes a second actuator panel movable on the side panel means between a first position and a second position, and which first and second positions coincide with the closed and open positions of the second valve means.

7. The apparatus of claim 6 in which the second actuator means includes second actuation means for moving the second actuator panel between the first and the second positions to move the second valve means between its closed and its open positions.

8. The apparatus of claim 7 in which the second actuator means further includes a second solenoid actuable to move the second actuator panel to its second position from its first position to move the second valve means to its open position from its closed position.

9. The apparatus of claim 8 in which the second actuator means further includes a tension spring for moving the second actuator panel to its first position from its second position to move the second valve means to its closed position from its open position.

10. The apparatus of claim 6 in which the second actuator means further includes second actuation means for moving the second actuator panel between the second and first positions to move the second valve means between its open and its closed positions.

11. The apparatus of claim 10 in which the second actuator means includes a second solenoid actuable to move the second actuator panel to its first position from its second position to move the second valve means to its closed position from its open position.

12. The apparatus of claim 10 in which the second actuator means further includes a tension spring for moving the second actuator panel from its first position to its second position to move the second valve means from its closed position to its open position.

13. The apparatus of claim 1 in which the first and second slots of the slot means comprise a pair of arcuate slots spaced apart from each other and extending through the first side panel of the side panel means.

14. The apparatus of claim 13 in which the first valve means includes a first flapper valve disposed between the first and second side panels; and a first pivot rod secured to the first flapper valve and extending between, and pivotally secured to, the first and second side panels on which the first flapper valve pivots in moving between the closed and open positions.

15. The apparatus of claim 14 in which the second valve means includes a second flapper valve disposed between the first and second side panels, and a second pivot rod secured to the second flapper valve and extending between, and pivotally secured to, the first and second side panels remote from the first pivot rod, and on which the second flapper valve pivots in moving between the closed and open positions.

16. The apparatus of claim 15 in which the side panel means further includes a first fixed panel extending between the first and second side panels and disposed beneath the first flapper valve and defining, with the first and second side panels, a coin box path for receiving coins from the coin escrow box when the first flapper valve moves from its closed to its open position, and a second fixed panel extending between the first and second side panels and disposed beneath the second flapper valve and defining, with the first and second side panels, a coin return path for receiving coins from the coin escrow box when the second flapper valve is in its open positon.

17. The apparatus of claim 16 in which the side panel means further includes first and second guide means on the first side panel for receiving, respectively, the first and second actuator panel means and in which the first and second actuator panel means respectively move to pivot the respective first and second flapper valves.

18. The apparatus of claim 17 in which the first actuator panel means includes a first actuator panel movable in the first guide means; and the first actuator slot is in the first actuator panel, and the second actuator panel means includes a second actuator panel movable in the second guide means, and the second actuator slot is in the second actuator panel.

19. The apparatus of claim 18 in which the first actuator means includes a first solenoid secured to the first side panel and to the first actuator panel for moving the first actuator panel in the first guide means to pivot the first flapper valve to allow coins in the coin escrow box to move to the coin box path, and the second actuator means includes a second solenoid secured to the first side panel and to the second actuator panel for moving the second actuator panel in the second guide means to pivot the second flapper valve for controlling the coin return path.

20. The apparatus of claim 18 in which the first actuator panel means further includes a first lock notch on the first actuator slot in the first actuator panel for receiving the first cam rod to lock the first flapper valve in its closed position until the first actuator means moves the first actuator panel to pivot the first flapper valve from its closed to its open position.

21. The apparatus of claim 20 in which the second actuator panel means further includes a second lock notch on the second actuator slot in the second actuator panel for receiving the second cam rod to lock the second flapper valve in its closed position until the second actuator means moves the second actuator panel to pivot the second flapper valve from its closed position to its open position.

* * * * *